US006024394A

United States Patent [19]

Marler

[11] Patent Number: 6,024,394

[45] **Date of Patent: *Feb. 15, 2000**

[54] APPARATUS WITH A CENTERING MEMBER FOR LATCHING AND UNLATCHING A LOAD SUSPENDED FROM A LIFTING LINE

[76] Inventor: Joseph E. Marler, 29736 W. Highland St., Livingston, La. 70754

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,141

[22] Filed: Apr. 24, 1997

Related U.S. Application Data

[63] Continuation-in-part of application No. 08/780,693, Jan. 8, 1997, Pat. No. 5,791,710, which is a continuation-in-part of application No. 08/657,933, May 30, 1996, Pat. No. 5,762, 389.

[51] Int. Cl.[7] ..... B66C 1/16

[52] U.S. Cl. ..... 294/75; 294/67.5; 294/82.35

[58] Field of Search ..... 294/67.1–67.3, 294/67.5, 68.3, 75, 81.3, 81.5, 81.54–81.56, 82.27, 82.35; 24/600.4–600.8, 601.6; 59/85, 86, 93

[56] References Cited

U.S. PATENT DOCUMENTS

| | | | |
|---|---|---|---|
| 1,198,139 | 9/1916 | Lyon . | |
| 1,215,046 | 2/1917 | Montgomery | 294/75 X |
| 1,862,081 | 6/1932 | Grant | 294/67.21 |
| 1,908,146 | 5/1933 | Helton | 294/75 |
| 2,293,653 | 8/1942 | Katz . | |
| 2,673,116 | 3/1954 | Baird | 294/75 |
| 3,462,945 | 8/1969 | Barber | 294/82.35 X |
| 3,895,836 | 7/1975 | Barnes | 294/82.35 |
| 4,148,514 | 4/1979 | McCullough . | |
| 5,152,567 | 10/1992 | Raber | 294/82.35 |

FOREIGN PATENT DOCUMENTS

| | | | |
|---|---|---|---|
| 1220401 | 5/1960 | France | 294/67.21 |
| 3030041 | 2/1982 | Germany | 294/82.35 |
| 454396 | 6/1968 | Switzerland | 294/67.2 |
| 682440 | 8/1979 | U.S.S.R. | 294/82.35 |
| 1346562 | 10/1987 | U.S.S.R. | 294/82.35 |

*Primary Examiner*—Johnny D. Cherry
*Attorney, Agent, or Firm*—Domingue & Waddell, PLC

[57] ABSTRACT

An apparatus for releasing an attached load, with the load being attached with a sling is described. Generally, the apparatus comprises a plate having an underside face, and a latch member, operatively associated with the underside face, for latching and unlatching the sling from the load. The apparatus may contain an activating line attached with the latch member, and activating member, operatively associated with the activating line, for activating the latch member. In the preferred embodiment, the latch member comprises a first member mounted on the plate, with the member having an opening therein, a second member mounted on the plate, with the member having an opening therein, and a third member mounted on the plate, with the member having an opening therein. A load pin is placed within the openings. A fulcrum point is provided so that the load pin may be pivoted for latching and unlatching. A gravity centering system is also included that allows for a single point release system.

15 Claims, 13 Drawing Sheets

APPARATUS WITH A CENTERING MEMBER FOR LATCHING AND UNLATCHING A LOAD SUSPENDED FROM A LIFTING LINE

This application is a continuation-in-part of application Ser. No. 08/780,693 filed on Jan. 8, 1997, now U.S. Pat. No. 5,791,710, which is a continuation-in-part of application Ser. No. 08/657,933 which was filed on May 30, 1996, now U.S. Pat. No. 5,762,389. This invention relates to a device used for loading and unloading of material. More particularly, but not by way of limitation, this invention relates to an apparatus used to latch and unlatch a load of material suspended from a lifting line.

BACKGROUND OF THE INVENTION

In the construction, manufacture, and/or general maintenance of industrial, residential, commercial and petrochemical facilities, the operators will find it necessary to move various types of loads. This type of movement involves the lifting of equipment, structural members and very heavy cargo. Due to the weight and nature of the equipment, structural members and cargo, and its interaction with the human operators, various surety standards have been developed in order to aid in the safety of the worker. One such regulation is known as the "100% TIE-OFF". Basically, this requires for tieing off the worker to a fixed point via a connecting line and a harness worn by the worker. The "100% TIE-OFF" is applicable when the worker is off the ground 6 feet or higher.

The added safety features, however, may also effect the productivity. The worker, therefore, has to stay tied off while six feet or more off the ground, 100% of the time. As the material is moved from a first position to a second position, the rigging must be rigged-up or rigged-down, depending on the sequence of the operation. Thus, the moving of material from one point to a second point is slowed. Of course, the other associated workers and machinery (crane, operator, ground crew, etc.) are in a stand-still while the connector rigs down the connection and then maneuvers to the sling which carried the load up to him.

Thus, there is a need for a device that functions as a latching and unlatching mechanism that allows the worker to safely and efficiently release the sling means after the material, equipment and/or cargo have been properly positioned. There is also a need for an apparatus that is safer and quicker from the viewpoint of the worker so that the overall worker movement about the construction site is decreased. There is also a need for a device that will allow for a single point release system so that a load may be latched and/or unlatched from a single connection position.

SUMMARY OF THE INVENTION

An apparatus for releasing an attached load, with the load being attached with a sling means for carrying loads, is described. Generally, the apparatus comprises a plate having an underside face; and latch means, operatively associated with the underside face, for latching and unlatching the sling from the load. The apparatus may contain an activating line attached with the latch means; and activating means, operatively associated with the activating line, for activating the latch means.

The apparatus may further comprise a spreader bar that is selectively attached to the plate. The sling means includes a first sling having a first end connected to a crane and a second end connected to the spreader; a second sling having a first end connected to a crane and a second end connected to the spreader; and, a third sling having a first end connected to the latch means and a second end connected to the load so that the latch means upon activation, releases the third sling.

In the preferred embodiment, the latch means comprises a first member mounted on the plate, with the member having an opening therein, a second member mounted on the plate, with the member having an opening therein, and a third member mounted on the plate, with the member having an opening therein. In this embodiment, the first member and second member form a first chamber to receive the first end of the third sling, and the second member and the third member form a second chamber. A rod is slidably disposed within said openings of the first, second and third member thereby forming the chamber area. A biasing means, disposed about the rod, for biasing the rod into a closed position and in engagement with the openings of the first, second and third members is also provided.

In the preferred embodiment, the activating means comprises an orienting plate operatively attached to the spreader bar along with a pulley member mounted on the orienting plate. In this embodiment, the activating line is operatively associated with the pulley member.

In a second embodiment herein disclosed in FIGS. 5 through 8, a latch mechanism is claimed. Generally, the latch mechanism comprises a connection plate, a latch means, and a key member adapted to the latch means for engaging the latch means in a locked position. The latch means will include: a carrier plate attached to the underside portion of the connection plate; a guide member operatively connected to the carrier plate, with the guide members having a passage member; a load pin being operatively adapted within the passage member; and, biasing means, operatively associated with the load pin, for biasing the load pin into engagement.

In one embodiment, the guide member comprises a first member being adapted to the carrier plate; a second member being adapted to the carrier plate; a third member being adapted to the carrier plate; and a fourth member being adapted to the carrier plate. The first member and the second member form a chamber for insertion of a sling member therein, and the key member is operatively associated with the first member so that the load pin locks onto the first member.

In this embodiment, the passage member comprises a first opening having a first diameter formed within the first member, a second opening having a second diameter formed within the second member, a third opening having a third diameter formed within the third member, a fourth opening having a fourth diameter formed within the fourth member. Also, the first diameter, second diameter, third diameter, and fourth diameter are axially offset relative to each other in a descending order.

The latch mechanism will further include a guide pin operatively associated with the load pin. A first channel formed in the third opening and formed to slidably receive the guide pin and a second channel formed in the fourth opening and formed to slidably receive the guide pin. In the preferred embodiment, the latch mechanism provides a fulcrum point for the load pin, with the fulcrum point being formed on the third member.

The latch mechanism may further comprise a lip member formed in the second opening to engage the key member within the second opening, a first roller bearing member operatively positioned within the first channel, and a second roller bearing member operatively positioned within the second channel. The latch mechanism may also include a load pin handle being associated with the load pin and adapted to receive an activation line for activating the load pin.

A method of carrying a load with a releasing latch is also disclosed. The method includes exerting a downward force via the sling means in a closed chamber so that the load can be carried. Next, the downward force is slackened via the sling means in the closed chamber so that the load would come to rest on a foundation. Then, the load pin can be pivoted on a fulcrum point created in the guide member. The operator would then urge the load pin through the passage in a first direction so that an open chamber is created and the sling may be released from the open chamber.

The method may further comprise placing the sling means back into the opened chamber and urging the load pin through the passage in a second direction so that the closed chamber is created. Next, the load pin is pivoted on the fulcrum point so that the key means engages the guide member. The operator can then lift the load from the foundation which in turn causes a downward force to be exerted via the sling means in the closed chamber so that the load pin is locked in place and the load can be carried to the required location.

In the preferred embodiment of this application seen in FIGS. 9–12, an apparatus for releasing an attached load via a single point release system is disclosed. This apparatus comprises a single point sling means for attaching the load to a single connection point; a connection plate having an underside face; a latch member, operatively associated with the underside face, adapted for latching and unlatching the sling from the load; an extension member stretching from the connection plate; and, centering means, operatively associated with the connection plate and the extension member, for urging the apparatus into a gravity center position. The apparatus may further include an activating line attached to the latch means and an activating means, operatively associated with the activating line, for activating the latch means.

In the preferred embodiment, the centering means contains a swing arm having a first end and a second end, with the first end of the swing arm being connected to the connection plate; and, a spring member having a first end and a second end, with the first end of the spring member being attached to the second end of the swing arm and the second end of the spring member being attached to the extension member. Thus, the spring biases the swing arm into the gravity center position.

The latch member may comprise: a carrier plate attached to the underside portion of the connection plate; a guide member operatively connected to the body plate, the guide members having a passage therethrough; a load pin having a first end and a second end, the load pin being operatively adapted within the passage; and, biasing means, operatively associated with the load pin, for biasing the load pin into engagement.

In this embodiment, the guide member comprises a first member being adapted to the carrier plate; a second member being adapted to the carrier plate; a third member being adapted to the carrier plate; and a fourth member being adapted to the carrier plate and wherein the first member and the second member form a chamber for insertion of a sling member therein.

The apparatus may further include: a guide pin operatively associated with said load pin; a first channel formed in said third opening and formed to slidably receive the guide pin; and, a second channel formed in the fourth opening and formed to slidably receive the guide pin. Thus, a fulcrum point is formed on the third member.

In one embodiment, the first opening has a first diameter, the second member has a second opening having a second diameter, the third member has a third opening having a third diameter, and the fourth member has a fourth opening having a fourth diameter. The invention teaches having the first diameter, second diameter, third diameter, and the fourth diameter being axially offset relative to each other.

An advantage of the present invention includes making the loading and unloading of equipment, material and cargo safer. Another advantage is the safety aspect of the latch mechanism to prevent premature release. The design allows for release only when there is no load within the chamber. Also, the loading and unloading may also be done faster and more efficient. Another advantage is the types of loads the device may be used with vary widely. For instance, the device may be used for positioning large beams, rafters, or joists. Alternatively, the device may be used while loading or unloading containers, vessels and tanks. The device may be used in the construction of structures and buildings, or in the petrochemical business, or in the offshore drilling of wells. This list is meant to be illustrative.

Still yet another advantage is that the invention may be used to suit varying capacity. Yet another advantage is that an additional safety latch with release cord can be added for added surety against accidental release. The device itself may be bolted or welded to the top of vessels and/or containers, and used therewith for the lifting and/or lowering of those vessels and/or containers.

Another advantage is the use of the single point release system rather than having to use a spreader type system. Yet another advantage is that the device may be attached at a single connection point shackle that in turn is connected to a hook and ball. Yet another advantage is use of the centering means for obtaining gravity center of the device in use which in turn balances the latch. These and many other advantages will become apparent following the detailed description of the preferred embodiments.

A feature of the present invention includes having a key member associated with the load pin that is used to lock the load pin in place. Another feature is the use of a plurality of guide members that have a passageway therein for placement of the load pin. Yet another feature includes a forming fulcrum point on the guide member. Another feature includes having a guide bar included with the load pin, with the guide bar cooperating with the channels contained on the guide members.

A feature of the present invention is use of a novel centering means. Another feature is the use of the swing arm that is pivotly attached to the connection plate. Still yet another feature is the use of the spring that allows the swing arm to be pivoted from a first position to a second position. Yet another feature is that the first position corresponds to a centered position in the unloaded capacity while the second position corresponds to a centered position in the loaded capacity.

BRIEF DESCRIPTION OF THE PREFERRED EMBODIMENTS

DESCRIPTION OF THE PREFERRED EMBODIMENTS

Figure 1A:
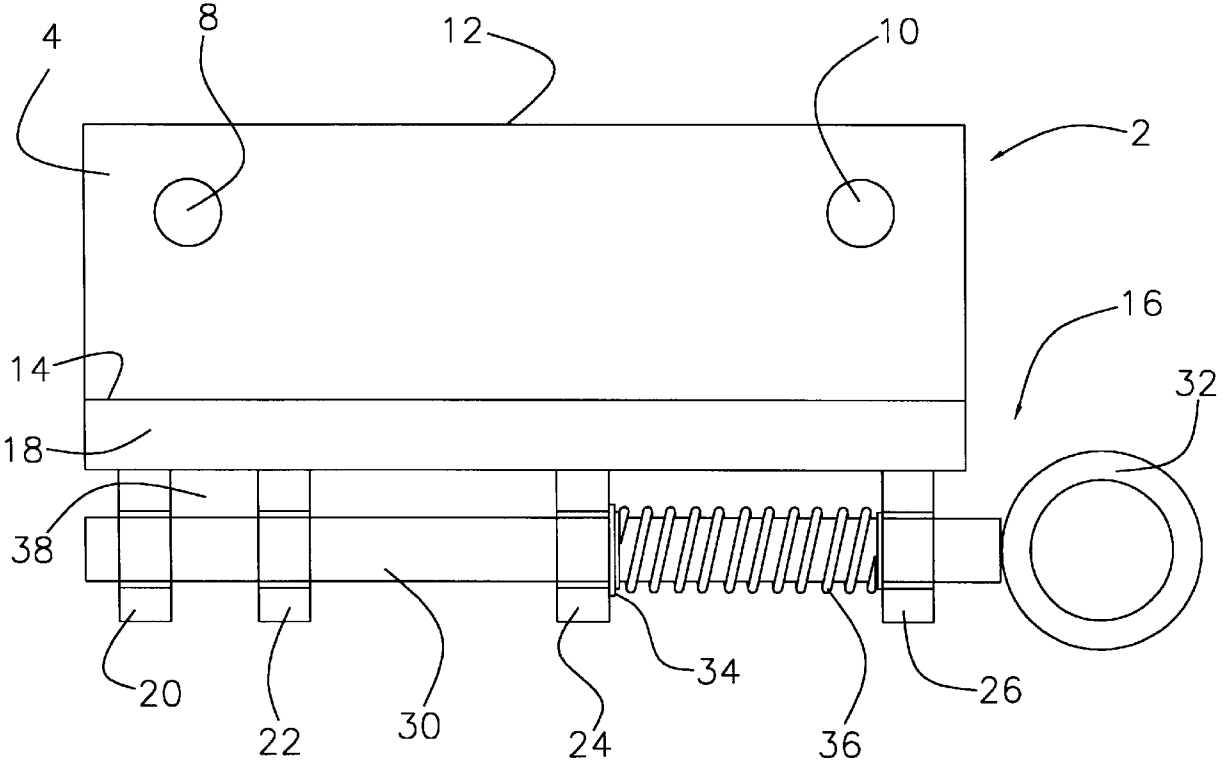
FIG. 1A is a front elevation view of the releasing apparatus of the present invention.
Figure 1B:
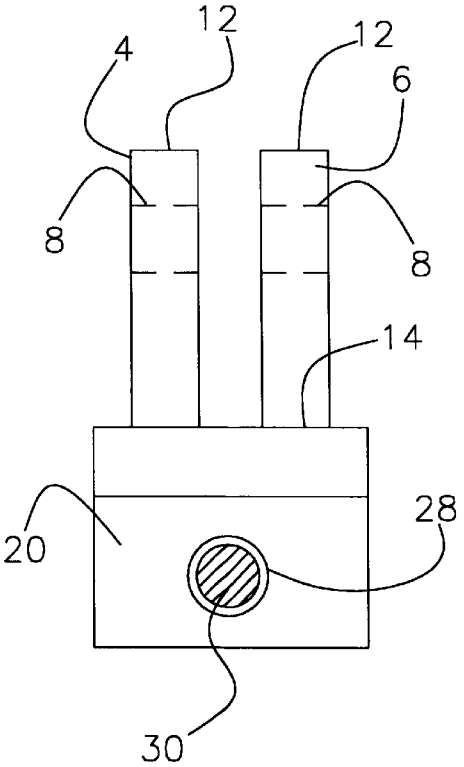
FIG. 1B is a side elevation view of the apparatus of FIG. 1

Referring to FIG. 1A, a front elevation view of the releasing apparatus 2 of the present invention is illustrated. The apparatus 2 will contain a first plate 4 and second plate 6, with the plates 4, 6 having contained therein openings 8 and 10 for placements of securing means (not shown) such as a bolt. As depicted, the plates 4 and 6 are rectangular with an upper side 12 and an underside 14.

The underside 14 has attached thereto the latch means 16 for latching and unlatching sling means (see FIG. 2) that is operatively associated with the load being transported. As seen in FIG. 1A, the latch means has generally rectangular plate la that will have extending laterally therefrom first member 20, second member 22, third member 24, and fourth member 26. The members 20–26 will have formed therein openings 28.

A rod 30 is positioned through the openings 28, as shown in the various figures. The rod 30 has a first end 32 that in the preferred embodiment is a circular handle member. The rod 30 will have attached thereto a washer 34 that in turn has abutting biasing means 36 for biasing the rod into the closed positioned as seen in FIG. 1A. In the preferred embodiment, the biasing means 36 is conical spring 36 that bias the rod 30 closed. Thus, with the biasing means 36 slidably disposed about the rod 30, the latch means 16 is positive acting, i.e., the operator must exert pulling force on the handle member 32 in order to pull the rod 30 into an open position (also referred to as the released position).

As shown in FIG. 1A, chamber ha is formed relative to the rod 30 and members 20, 22 while the rod 30 is in the closed position. It should be noted that the members 24 have been added to the preferred embodiments so that the rod 30 better aligns with the openings 28 as well as for structural support. As will be more fully set out hereinafter, the sling means may be inserted into the chamber 38. Thus, when the rod is pulled via handle end 32, the operator may insert the sling into the chamber 38, or alternatively, the operator may withdraw the sling from the chamber 38.

Figure 2:
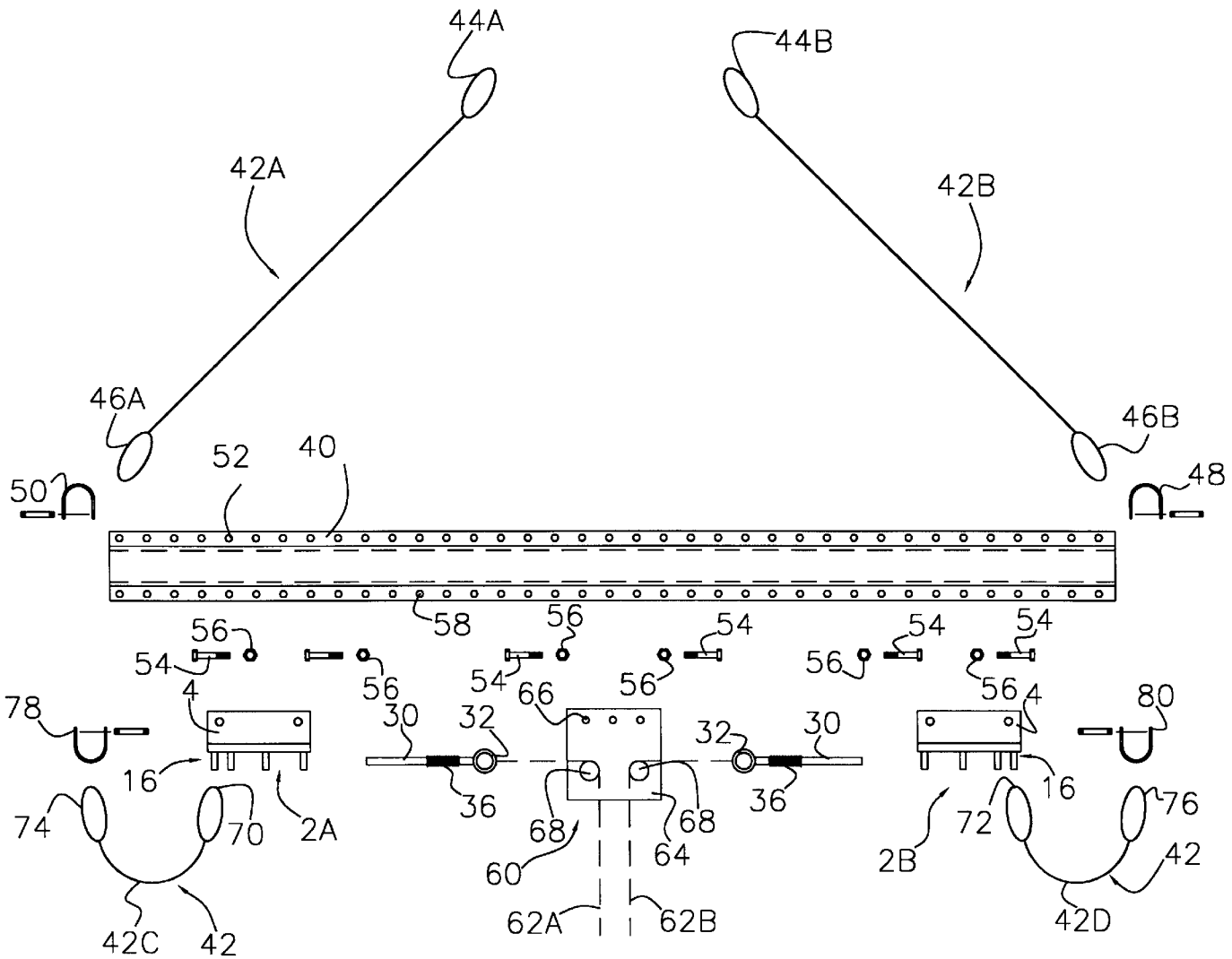
FIG. 2 is a front elevation view of the apparatus of the present invention with spreader bar and sling means.

Referring now to FIG. 2, a front elevation view of the apparatus 2 of the present invention with spreader bar 40 and sling means 42 is illustrated. It should be noted that the system of FIG. 2 is one system by which the apparatus 2 of the present invention may be utilized. The device 2 itself may be bolted or welded to the top of vessels and/or containers, and used therewith for the lifting and/or lowering of those vessels and/or containers. Further, it should also be noted that throughout the application, like numbers in the various figures refer to like components.

As will be understood by those of ordinary skill in the art, the sling means 42 contains individual sling means 42A and 42B, with sling means 42A having a first end 44A and sling means 42B having a first end 44B, with the ends 44A and 44B that may be attached, for instance, to means for lifting a load such as a crane (not shown). The second end 46A and 46B of the sling means 42A and 42B will be attached to the spreader bar 40 via shackles 48 and 50. The shackles 48, 50 fit through the upper series of apertures 52 contained on said spreader bar 40.

As depicted in FIG. 2, there are two (2) apparatus (designated as 2A and 2B) that are attached to the spreader bar 40. The apparatus 2A and 2B are attached via the bolts 54 and nuts 56, with the bolts 54 being inserted into the lower series of apertures h and thereafter screwed into place via nuts 56.

FIG. 2 also illustrates the activating means 60 for activating the latch means 16. The activating means will include an activating line 62A and 62B with the activating line 62A and 62B having one end attached to the handle 32. Thus, each latch means 16 is independently activated. The activating means 60 will include an orienting plate 64 which will have contained therein apertures 66 for placement of a nut 56 and bolt 54 so that the orienting plate 64 will be attached to the spreader bar 40. The orienting plate 64 will also contain the pulley members 68, with the pulley members 68 being mounted on the orienting plate 64 such that the pulleys 68 are rotatable.

Thus, as the operator exerts a pulling force on the activating line 62A and/or 62B, the positive acting latch means 16 will cause the rod 30 to move so that the chamber 38 is opened. The pulleys 68 also allow for the activating line 62A, 62B to be in a horizontal plane relative to the handle end 32 so that the pull force is in the plane of the rod 30. Note that in this embodiment, the two separate activating lines 62A, 62B are independent of each other.

Also shown in FIG. 2 are the sling means 42C and 42D. The end 70 and end 72 of the slings 42C and 42D, respectfully, will cooperate and fit into the previously described chamber 38. The opposite ends of the slings 42C, 42D are ends 74 and 76. The ends 74 and 76 may be attached to the actual load to be lifted such as the joist seen in FIG. 3 via the shackles 78 and 80 as is well understood by those of ordinary skill in the art.

Figure 3:
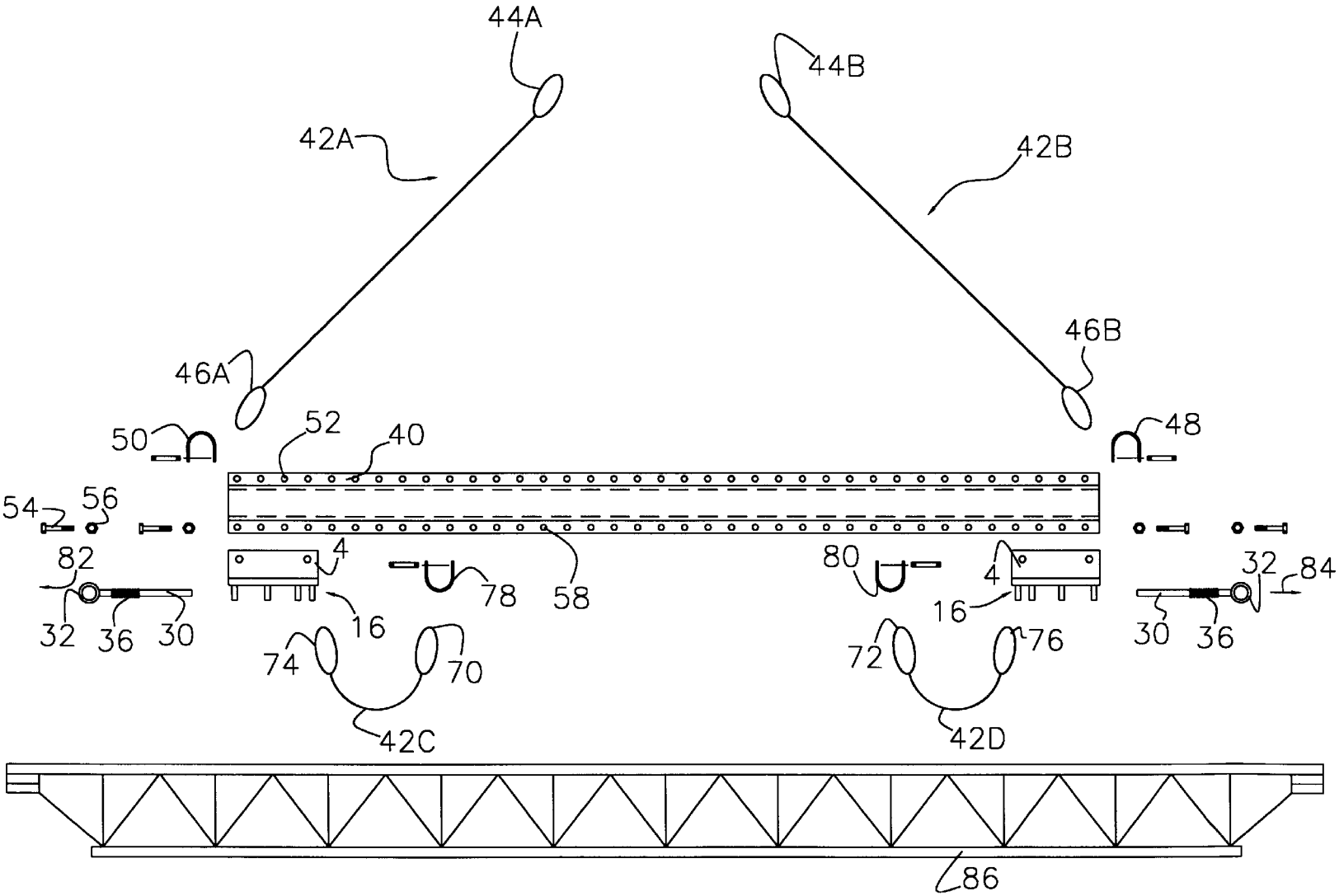
FIG. 3 is another system of the present invention along with joist member.

Referring now to FIG. 3, a second embodiment of the system herein disclosed is shown. The embodiment shown in FIG. 3 depicts the apparatus 2 oriented in a 180 degree rotated planar position as compared to the system of FIG. 2. Thus, the handle ends 32 must be pulled from the opposite direction as noted by the arrows 82 and 84. FIG. 3 also depicts the bar joist 86 which characterizes the load to be lifted and/or moved and/or supported. The operator would utilize the slings 42C and 42D for such lifting, moving and/or supporting.

The system of FIG. 3 would require attachment of the first plate 4 with the apertures 58 of the spreader bar 40 as previously described. The ends 74 and 76 are placed into the chamber 38. This is performed by exerting a pulling force 82, 84 on the handle end 32 thereby displacing the rod 30 sufficiently to place the ends 74 and 76 into the chamber 38.

The sling means 42C and 42D are then passed through the bar joist 86 (as is well understood by those of ordinary skill in the art). Thereafter, the ends 70 and 72 are attached to the spreader bar 40 via the shackles 78 and 80 with the end 70 being associated with the shackle 78, and the end 72 being associated with the shackle 80.

Figure 4:
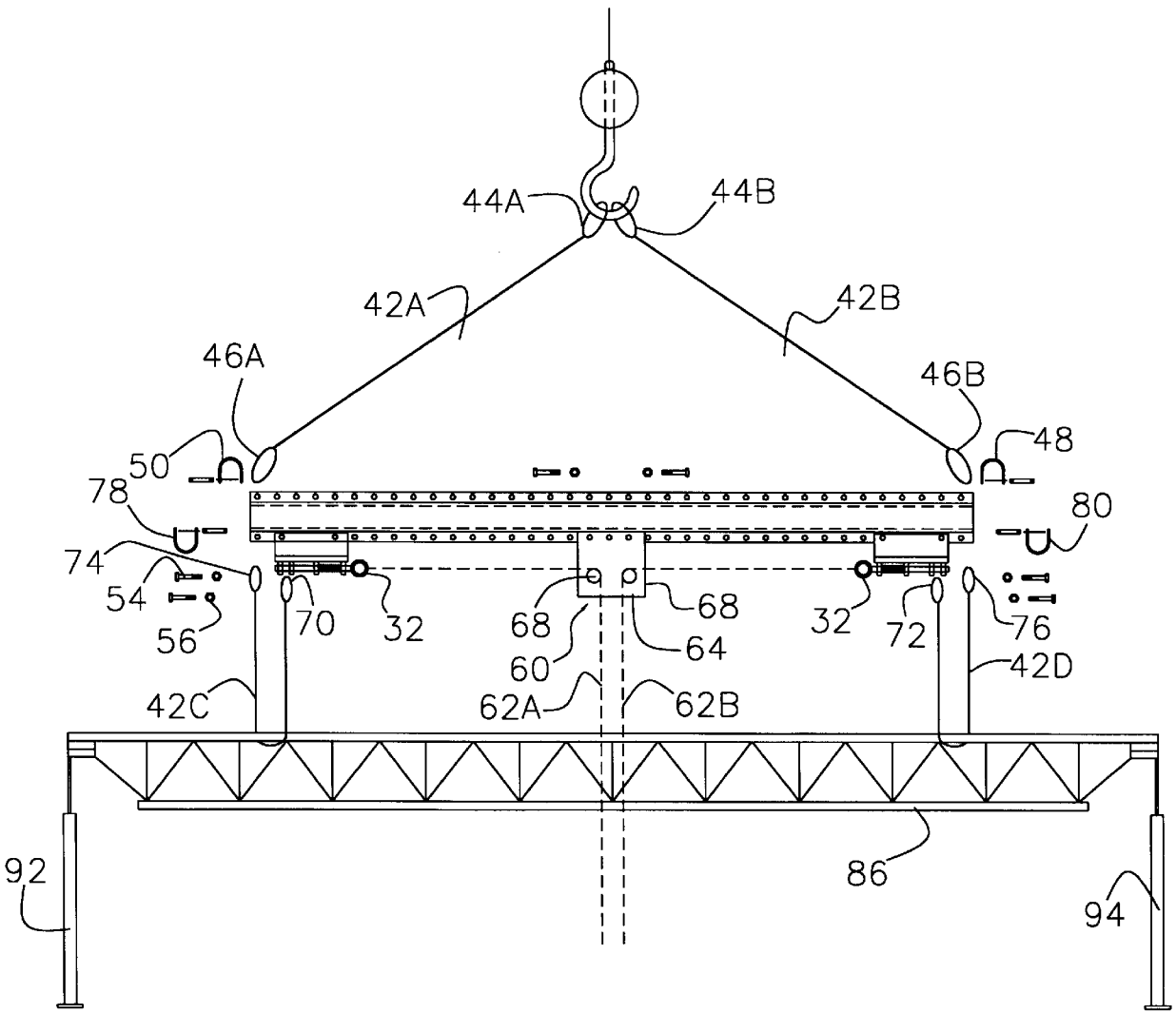
FIG. 4 is the system of FIG. 3 being positioned with crane at a construction site.

With reference to FIG. 4, the system of the preferred embodiment of the present invention is depicted. Thus, the sling means 42A and 42B are attached at one end 44A and 44B to a crane hook 88, with the crane hook being ultimately attached to crane line 90. The second ends 46A and 46B are attached to the spreader bar 40 via the shackles 48, 50. The apparatus 2 is also attached to the spreader bar 40 as previously described. The sling means 42C and 42D are looped about the bar joist 86. The ends 70 and 72 will be placed into the chamber 38 as previously described. The ends 74 and 76 will be attached to the spreader bar 40 via shackles 78.

Also depicted in FIG. 4 is the columns 92 and 94 that will have the bar joist 86 positioned thereon. The dimensions shown include a are height of approximately 20 feet and length of 40 feet. However, these dimensions are meant to be illustrative, and the invention is applicable to dimensions both smaller and larger than those shown.

FIG. 4 is an example of the apparatus 2 being used with spreader bar 40 and related rigging to handle a long span bar joist 86. In some cases, the bar joist are fabricated in excess of 100 feet in length. They generally are not very stable until all bracing is installed and present a problem to the erector when it is time to release the rigging. The problem is magnified when the crane operator is working in the "blind", such as the case when the crane operator can not see the rigging to be released. When using the apparatus 2 of the present invention, when the load is slacked, pull by the operator on the activating lines 62A and 62B will cause the rod 30 to shift laterally via the activating means 60 so that the chamber 38 is opened thereby allowing the ends 70 and 72 to fall out. Thus, the rigging is released and the crane is again swinging for the next piece. While a bar joist 86 is used, the apparatus 2 is certainly applicable to use with beams, bents, vessels, etc.

The apparatus 2 can be fabricated of −36 grade steel or molded similar to the common shackles. Further, the apparatus 2 can be designed to varying degree of capacity to suit a wide variety of needs. An additional safety latch with release cord can be added for added surety against an accidental release for some unknown reason.

Figure 5:
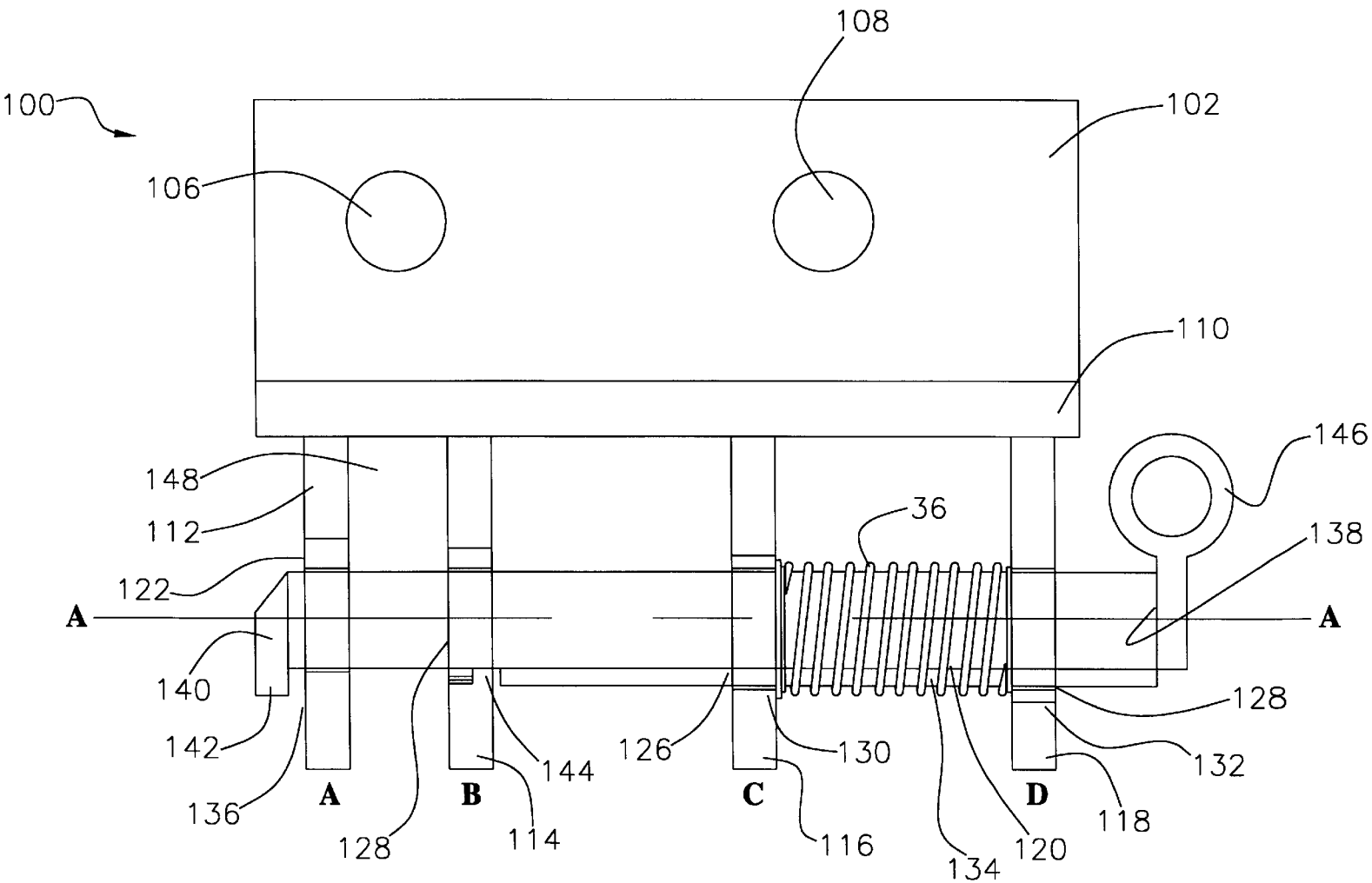
FIG. 5 is a second embodiment of the latch member in the locked position.

Referring now to FIG. 5, a second embodiment of the present invention will now be described. In this embodiment, the releasing latch 100 contains connection plates 102 and 104 that have apertures 106 and 108 therethrough for placement, for instance, of bolt means for connecting the release latch 100 to a spreader bar. The release latch 100 may be connected to other types of apparatuses. The apertures 106 and 108 are formed through the connection plates 102/104 off the lateral center due to the distribution of weight on the release latch 100.

The embodiment of FIGS. 5 through 8 depict latch means for latching and unlatching load. The latch means generally include carrier plate, guide member, and load pin. The latch means may also contain biasing means. The underside of connection plates 102/104 will be attached to the carrier plate 110. The carrier plate 110 is generally rectangular in shape. The carrier plate 110 will have extending therefrom first load/guide member 112, second load/guide member 114, third guide member 116, and fourth guide member 118. The guide members 112, 114, 116 and 118 will have passage therethrough that is operatively adapted to receive the load pin 120.

The passages through the guide members include the opening 122 formed in the guide member 112, the opening 124 formed in the guide member 114, the opening 126 formed in the guide member 116, and the opening 128 formed in the guide member 118. The openings 122, 124, 126 and 128 will have first diameter D1, second diameter D2, third diameter D3, and fourth diameter D4, with the diameters being axially offset relative to the first diameter D1, second diameter D2, third diameter D3, and the fourth diameter D4. In other words, each opening would have center point, with each center point being offset relative to the next opening in descending order as shown in FIGS. 5, 6 and 7.

Figure 6:
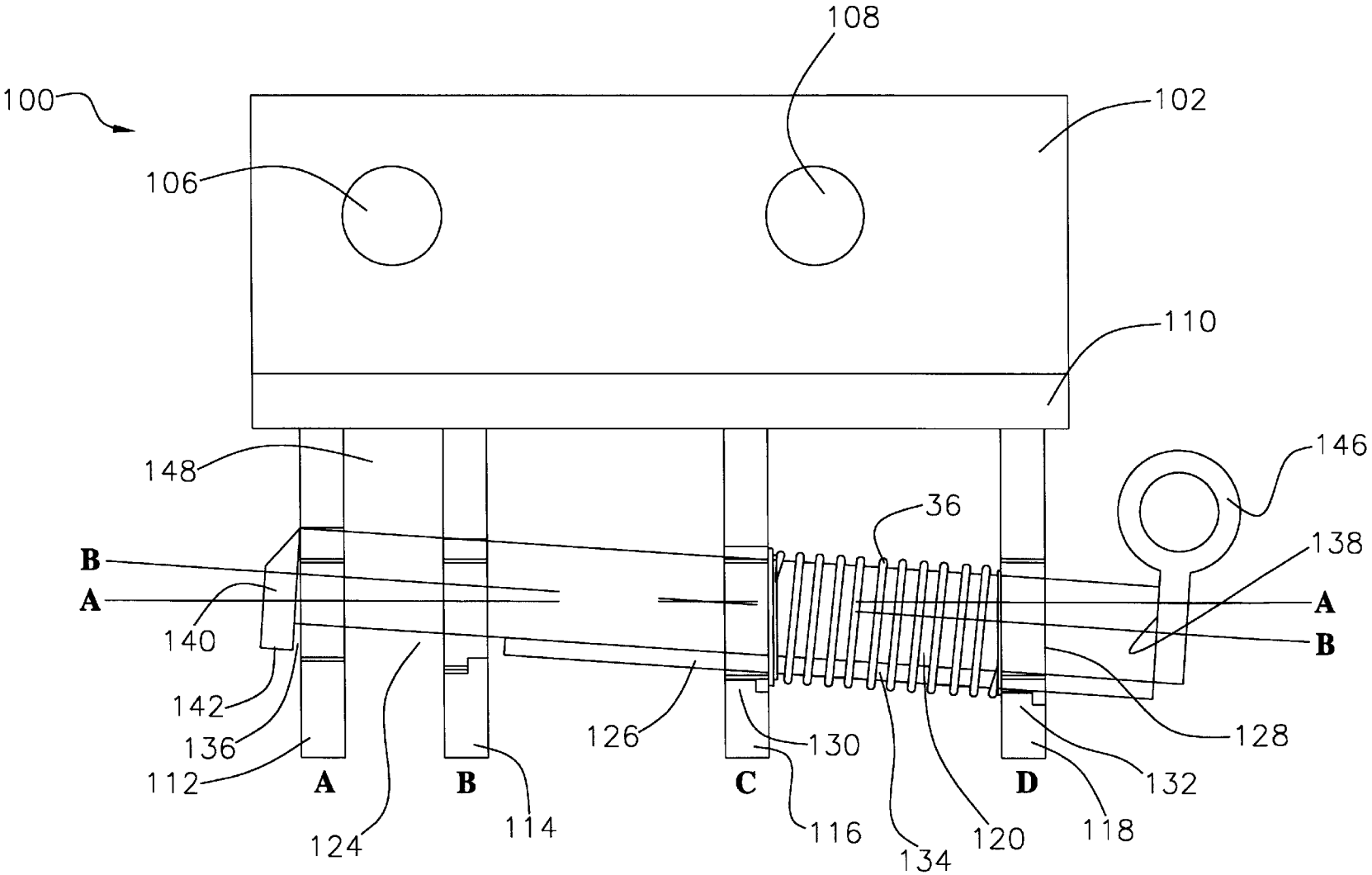
FIG. 6 is the latch member of FIG. 5 in the unlocked position.
Figure 7:
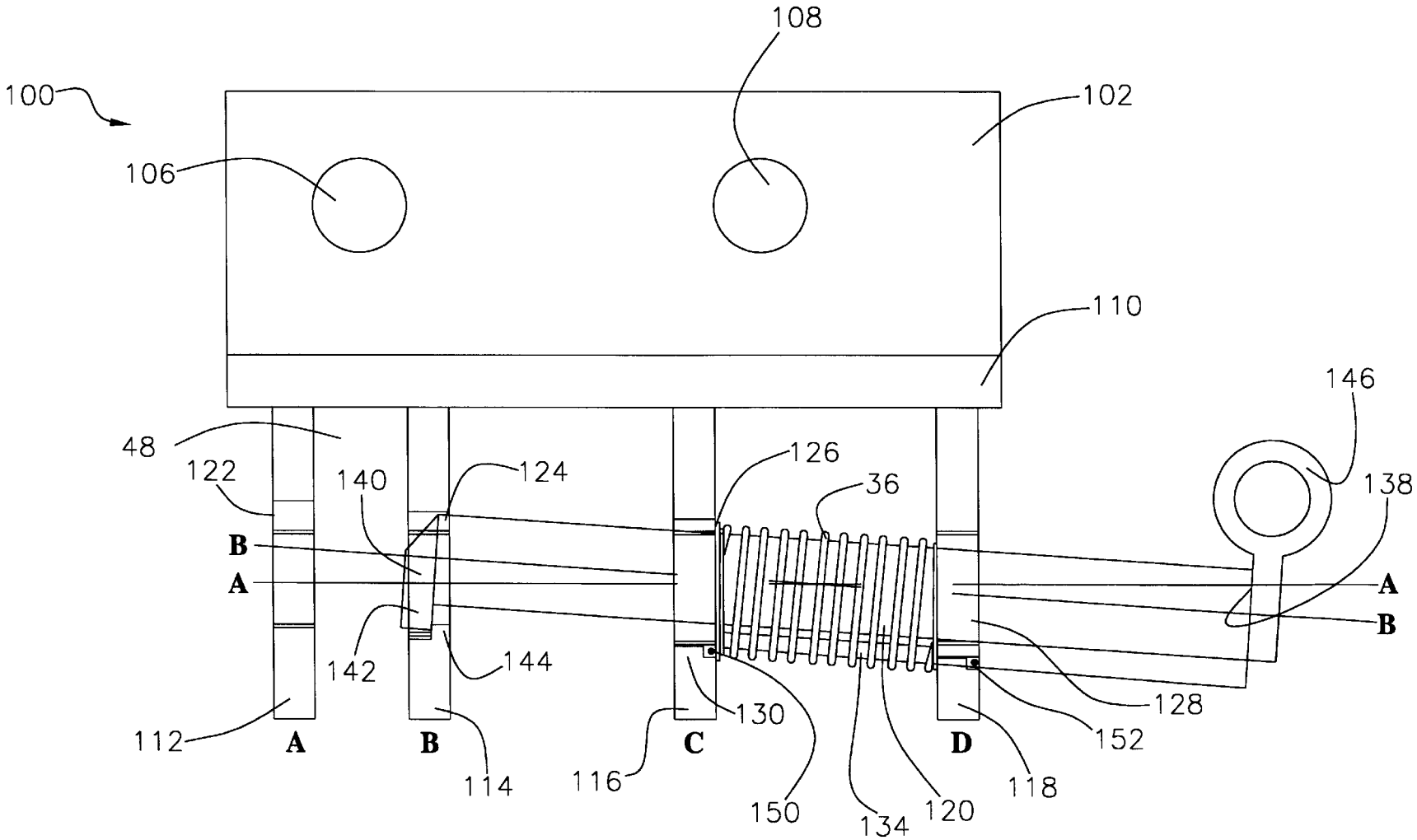
FIG. 7 is the latch member of FIG. 5 in the released position.

With the centers offset this way, the load pin 120 is allowed to pivot as seen in FIG. 6. In the preferred embodiment, the openings are oblong in shape. Further, the opening 126 in the guide member 116 has channel 130 provided within, and the opening 128 in the guide member 118 has channel 132. The channels 130, 132 will receive the guide pin 134, with the guide pin 134 being operatively associated with the load pin 120 as shown in FIG. 5.

In the preferred embodiment, the load pin 120 will have first end 136 and second end 138, with the first end 136 containing key member 140 for engaging the release latch 100 in locked position. As depicted in FIG. 5, the key member 140 overlaps the load pin 120, with the overlap segment represented by the numeral 142. Thus, the overlap segment 142 will engage the guide member 112 when the release latch 100 is in the locked position as seen in FIG. 5. As will be more fully explained with reference to FIG. 7, the opening 124 may contain lip 144 that will serve as stop for the advancement of the load pin 120 through the passages. In other embodiments, this area will be cut fully through member 114 since the lip is optional. Also included on the second end of the load pin 120 is the handle member 146. A fulcrum point located generally at the channel 130 is provided with the design herein disclosed, with the fulcrum point allowing the pivoting of the load pin 120 as seen in FIG. 7 such that the end 136 is pivoted upward and the end 138 is pivoted downward.

The release latch 100 will also include biasing means (not shown) which is disposed about the load pin 120 between the guide members 116 and 118. Thus, the biasing means will create positive force tending to force the load pin 120 through the passages and into the closed position. The biasing means will also act to resist movement of the load pin 120 out from the passages, i.e., resist opening of the release latch 100 as was fully explained earlier in the application.

Also depicted in FIG. 5 is the line A—A that has been drawn axially through the center of the load pin 120. As shown, the axial line A—A is essentially horizontal. Thus, with the action of the biasing means, any outward force to move the load pin to the right (open the release latch 100) will be opposed by the key 140 by engagement of the overlap 142 with the guide member 112 as well as the opposing force of the biasing means. With the load pin 120 in place, chamber 148 is created whereby the sling member may be placed. Thus, when downward force is exerted on the sling member (i.e. weight), the load pin is pivoted downward as seen in FIG. 5 and the release latch 100 is secure and an inadvertent release will be prevented.

Referring now to FIG. 6, the release latch 100 of FIG. 5 is illustrated in the unlocked position. It should be noted that like numbers appearing in the various figures refer to like components. Thus, the method of unlocking includes the operator slacking off weight such as positioning the load on the ground so that the sling (which had been placed in the chamber 148) is no longer exerting downward force on the load pin. The load pin 120 would then be pivoted on the fulcrum point located at the channel 130. As seen in FIG. 6, this pivoting causes the axial center line of the load pin to be shifted from the horizontal line A—A (seen in FIG. 5) to the offset axial line B—B. In the preferred embodiment, this pitch of the former axial line A—A to the current axial line B—B is approximately 4 to 8 degrees, with the exact amount of pitch depending on the particular load design characteristics.

In the position shown in FIG. 6, the load pin 120 may be moved to the release position. As shown, the key member 140 has been lifted, and in turn the overlap 142 has been lifted, so that the key member 140 can be passed through the opening 122. It should be noted that the opening 122 must be of sufficient diameter to allow the passage of the key member 140 therethrough. Also, the center of each opening is offset relative to the previous opening in descending order. Put another way, the line B—B runs basically through the centers of openings 122, 124, 126 and 128.

The operator may begin to exert pulling action on the handle 146 as set out in FIG. 7. In accordance with the teachings of the present invention, the operator exerts the pull force via the handle 146. The biasing means will compress once the force of the spring is overcome. Continued pulling on the handle 146 will allow the key member 140 through the opening 122 and partially through opening 124. In one embodiment, the guide members 116 and 118 may have contained within the openings 126 and 128 roller bearings 150 & 152 to aid in the movement of the load pin 120 therethrough. The continued movement of the load pin 120 is along the line B—B, in the direction of the force arrow labeled "Action". In the embodiment of FIG. 5, further movement will cause the lip 144 to engage with the overlap 142 of the key member 140 so that further movement of the load pin 120 will be prevented.

Thereafter, the operator may then extract the sling from the chamber 148. The operator may then, for instance, prepare another load for transportation. Thus, the operator may then place the sling means within the chamber 148. In order to return the releasing latch 100 to the locked position seen in FIG. 5, the operator would allow the biasing means to urge the load pin through the openings 124 and 122. Next, the operator would pivot the load pin 120 about the fulcrum point so that the axial center line of the load pin 120 is essentially horizontal (such as line A—A). Thereafter, the load may be picked up via the sling means so that load is encountered on the load pin in the chamber 148.

Figure 8A:
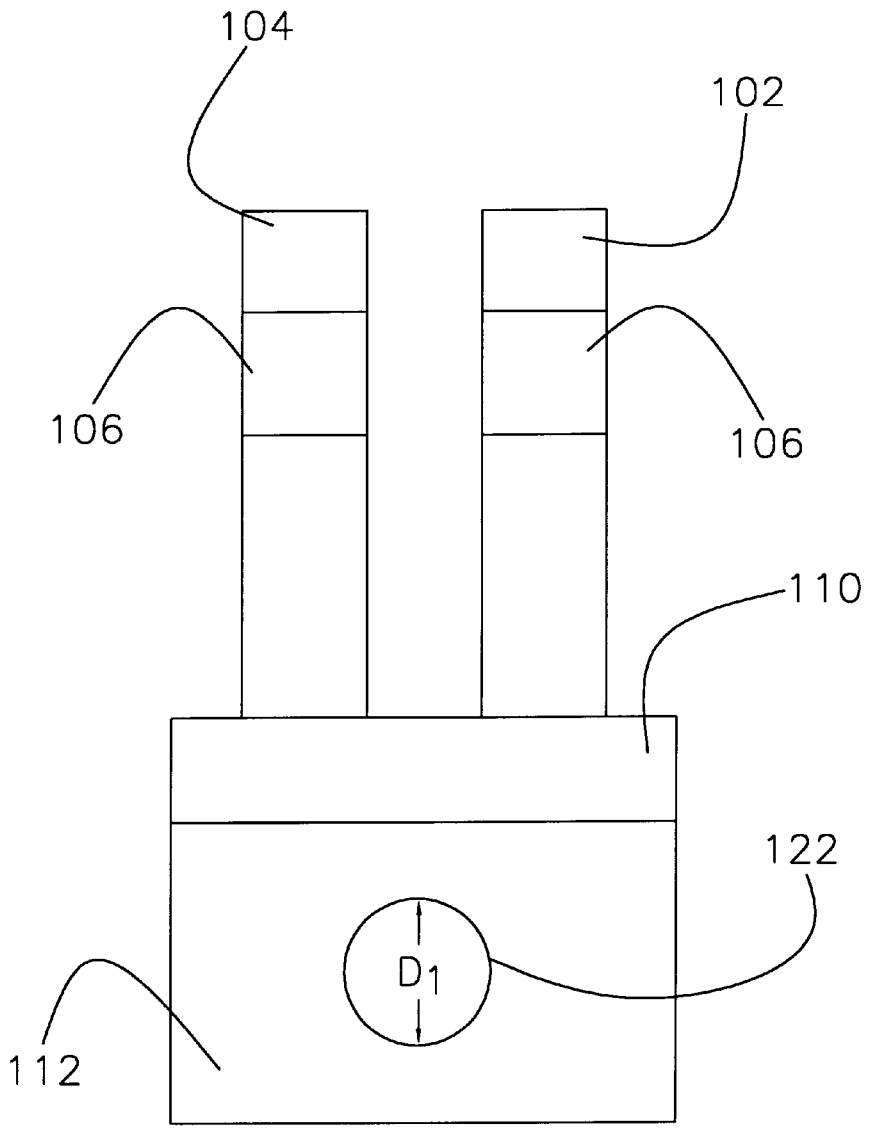
FIGS. 8A & 8B are end views of the latch member of FIG. 5.
Figure 8B:
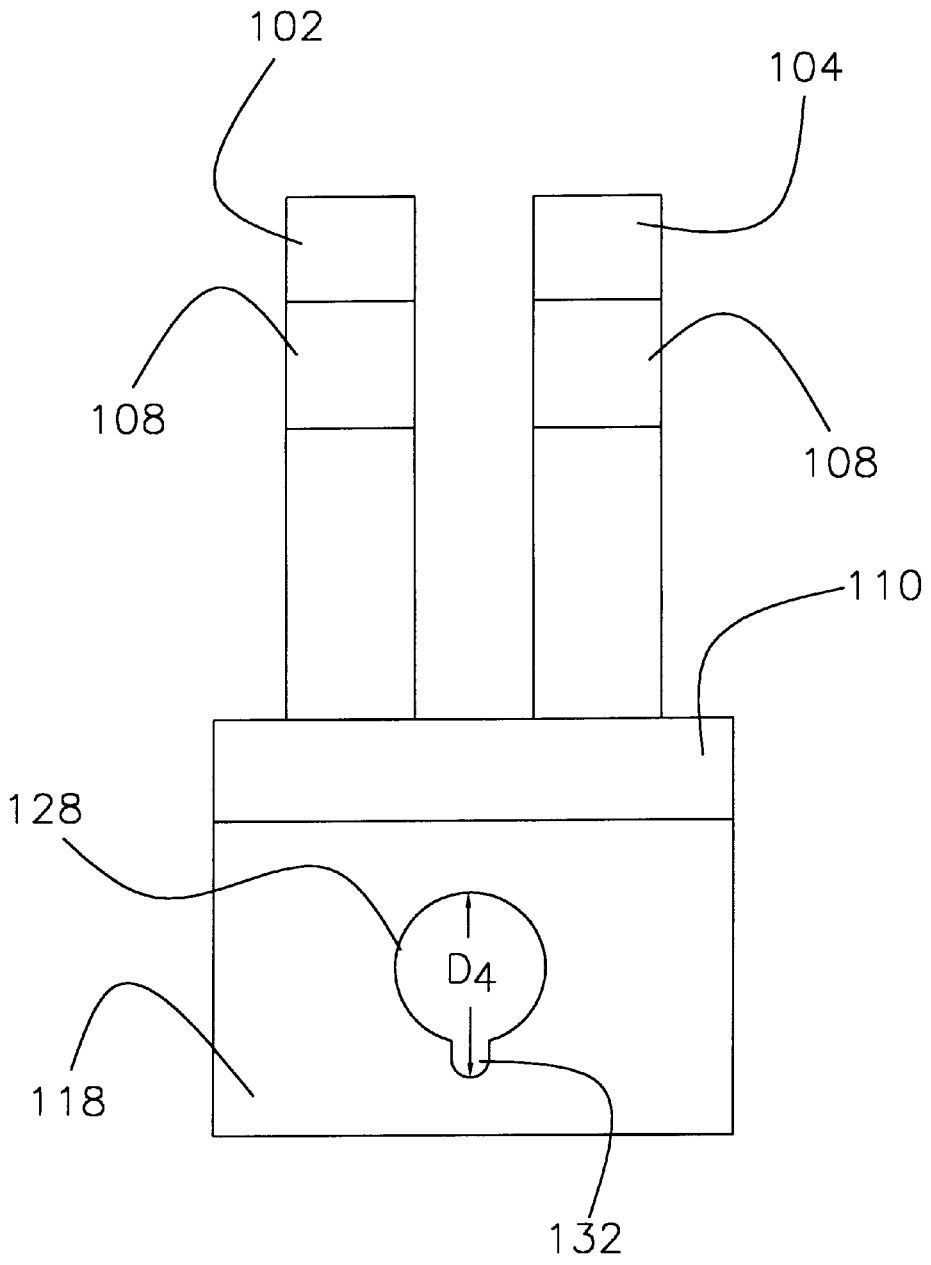

Referring now to FIGS. 8A & 8B, the end views of the latch member 100 of FIG. 5 will now be described. Thus, FIG. 8A depicts the first guide plate 112 with the oblong opening 122 therein, having generally diameter D1. FIG. 8B illustrates the fourth guide member 118 that has contained therein the oblong opening 128 having generally diameter D4. The opening 128 has provided therein the channel 132 wherein the guide pin 134 is slidably disposed. The releasing latch 100 of FIGS. 5 through 8 may be employed with the spreader, orienting plates, joist, etc. previously described. It should be noted that since the act of releasing (such as described with reference to FIG. 6) will require force acting on the center line B—B, the line of action of the opening force will also have to be offset at the same angle. This can be easily accomplished, for instance, by lowering the pulley 68 on the orienting plate 64 of the activation plate 60 and/or counterweight the load pin at or near handle 146.

Figure 9:
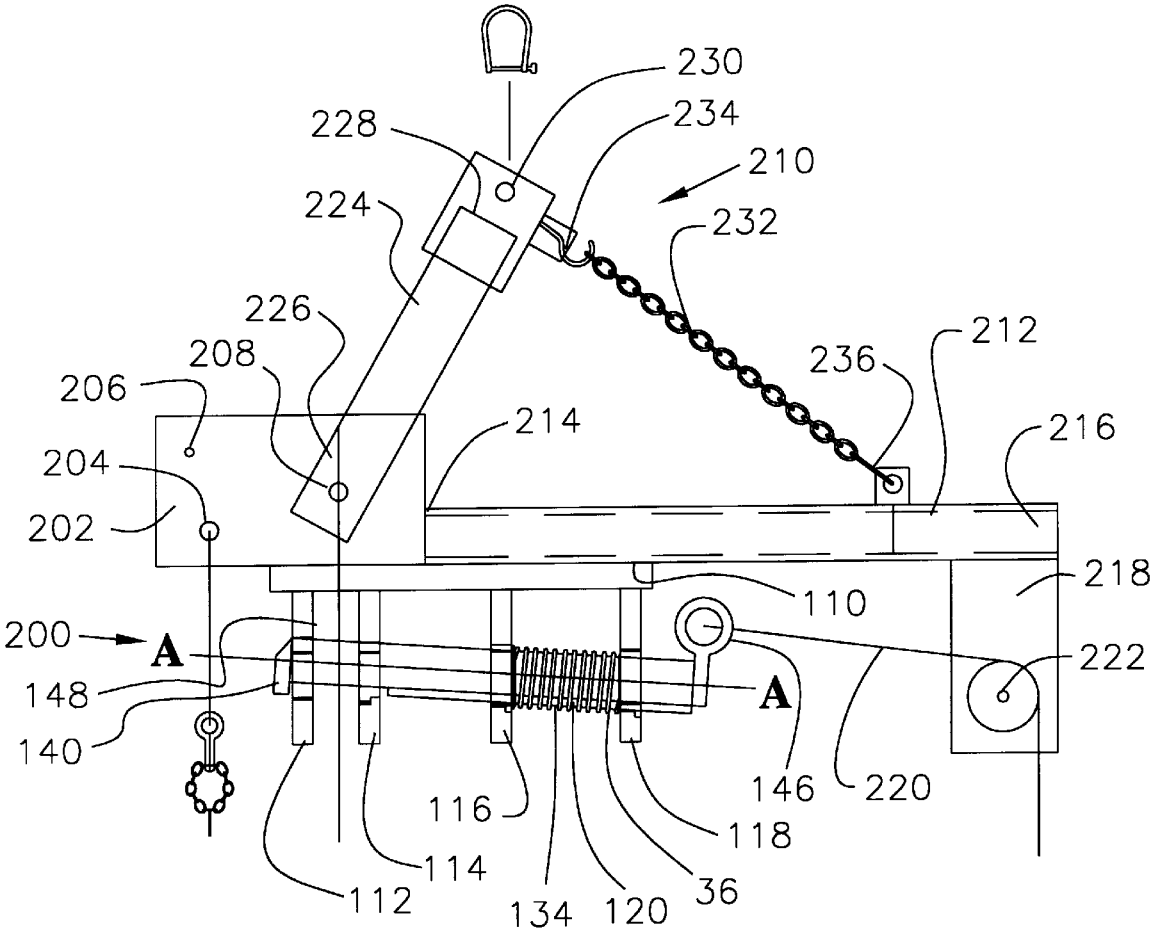
FIG. 9 is a third embodiment of the latch member in the balanced, unloaded position.

Referring now to FIG. 9, a third embodiment of the latch member 200 in the balanced, unloaded position is disclosed. It should be noted that like numbers appearing in the various figures represent like components. In the preferred embodiment of FIGS. 9–12, the releasing latch 200 contains connection plate 202 that has apertures 204, 206, 208 therethrough for placement, for instance, of bolt means for connecting the release latch 200 to a shackle. The release latch 200 may be connected to other types of apparatuses. The apertures 204, 206, 208 are formed through the connection plate 202 off the lateral center due to the distribution of weight on the release latch 200 as will be more fully explained later in the application. It should be noted that FIG. 9 is the preferred embodiment of this application.

The embodiment of FIGS. 9 through 12 depict latch means 200 for latching and unlatching a load similar to the latch of FIG. 5. Thus, the latch means 200 generally includes a carrier plate, guide member, load pin and means for centering and balancing the latch means. The latch means 200 may also contain biasing means. The underside of connection plate 202 will be attached to the carrier plate 110. The carrier plate 110 is generally rectangular in shape. The carrier plate 110 will have extending therefrom a first load/guide member 112, second load/guide member 114, third guide member 116, and fourth guide member 118. The guide members 112, 114, 116 and 118 will have passages therethrough that are operatively adapted to receive the load pin 120.

The passages through the guide members includes the opening 122 formed in the guide member 112, the opening 124 formed in the guide member 114, the opening 126 formed in the guide member 116, and the opening 128 formed in the guide member 118. The openings 122, 124, 126 and 128 will have a first diameter D1, second diameter D2, third diameter D3, and fourth diameter D4, with the diameters being axially offset relative to the first diameter D1, second diameter D2, third diameter D3, and the fourth diameter D4. In other words, each opening would have a center point, with each center point being offset relative to the next opening in descending order as shown in FIGS. 5, 6 and 7.

With the centers offset this way, the load pin 120 is allowed to pivot as seen in FIG. 6. In the preferred embodiment, the openings are oblong in shape. Further, the opening 126 in the guide member 116 has channel 130 provided within, and the opening 128 in the guide member 118 has channel 132. The channels 130, 132 will receive the guide pin 134, with the guide pin 134 being operatively associated with the load pin 120 as shown in FIG. 5.

In the preferred embodiment, the load pin 120 will have first end 136 and second end 138, with the first end 136 containing key member 140 for engaging the release latch 100 in a locked position. As depicted in FIG. 5, the key member 140 overlaps the load pin 120, with the overlap segment represented by the numeral 142. Thus, the overlap segment 142 will engage the guide member 112 when the release latch 100 is in the locked position as seen in FIG. 5. As was explained in the description of FIG. 7, the opening 124 may contain lip 144 that will serve as a stop for the advancement of the load pin 120 through the passages. In other embodiments, this area will be cut fully through member 114 since the lip is optional. Also included on the second end of the load pin 120 is the handle member 146. A fulcrum point located generally at the channel 130 is provided with the design herein disclosed, with the fulcrum point allowing the pivoting of the load pin 120 as explained earlier in the application with reference to FIG. 7 such that the end 136 is pivoted upward and the end 138 is pivoted downward.

The release latch 200 will also include biasing means 36, as depicted in FIGS. 9 through 12 which is disposed about the load pin 120 between the guide members 116 and 118. Thus, the biasing means will create a positive force tending to force the load pin 120 through the passages and into the closed position. The biasing means will also act to resist movement of the load pin 120 out from the passages, i.e., resist opening of the release latch 200 as was fully explained earlier in the application.

Also depicted in FIG. 9 is the line A—A that has been drawn axially through the center of the load pin 120. As shown in FIG. 9, the axial line A—A is offset relative to the horizontal ground level. In accordance with the teachings of the present invention, and as explained earlier in the application, with the load pin 120 in place, chamber 148 is created whereby the sling member may be placed. It should be noted that in FIG. 9, the aperture 208 and the chamber are axially aligned. When a load is applied to chamber 148 coupled with the action of the biasing means, any outward force to move the load pin to the right (open the release latch 100) will be opposed by the key 140 by engagement of the overlap 142 with the guide member 112 as well as the opposing force of the biasing means. Thus, when a downward force is exerted on the sling member (i.e., weight), the load pin is pivoted downward as seen in FIG. 10 and the release latch 200 is secure and an inadvertent release will be prevented.

The latch 200 of FIG. 9 also includes the centering means 210, operatively associated with the carrier plate 110 and the extension member 212, for centering the gravity center of the latch member 200 which in turn balances the latch member 200 to the proper orientation. As seen in FIG. 9, the extension member 212 is generally a support arm that extends from the connection plate 202. The extension member 212 will have the first end 214 connected to the connection plate 202 and the second end 216 will have attached thereto a block member 218 adapted for allowing the exertion of a force on the activation line 220. Note that the activation line can be used to attach to the handle member 146 for exerting a pulling force by an operator. As shown, the block member 218 contains pulley 222 that is in a lower plane relative to the handle 146. When in the unloaded position, the pulley 222, the handle 146 and the line of action are parallel to the center line A—A of the load pin.

The centering means 210 includes the swing arm 224 with the swing arm 224 having a first end 226 and second end 228. The first end 226 will have an aperture therein that will cooperate with the aperture 208 so that a pin may be placed therethrough thereby allowing pivoting of the swing arm 224. Further, the second end 228 may contain a section also including an aperture 230. The centering means 210 will also comprise the spring member 232, with the spring member 232 having a first end 234 and second end 236. The first end 234 will be connected to the swing arm 224 at the end 228 while the end 236 will be connected to the extension member 212. The spring 232 will be a tension spring with the strength and the length chosen such when there is no load applied to the chamber 148, the spring 232 is not only contracted (as seen in FIG. 9), but also the swing arm 224 is biased to an inclined position. Thus, in FIG. 9, the aperture 230 represents the point wherein the latch means is balanced relative to the horizonal ground level. The balanced position seen in FIG. 9 is referred to as the gravity center of the latch means 200 in the relaxed (unloaded) position.

Figure 10:
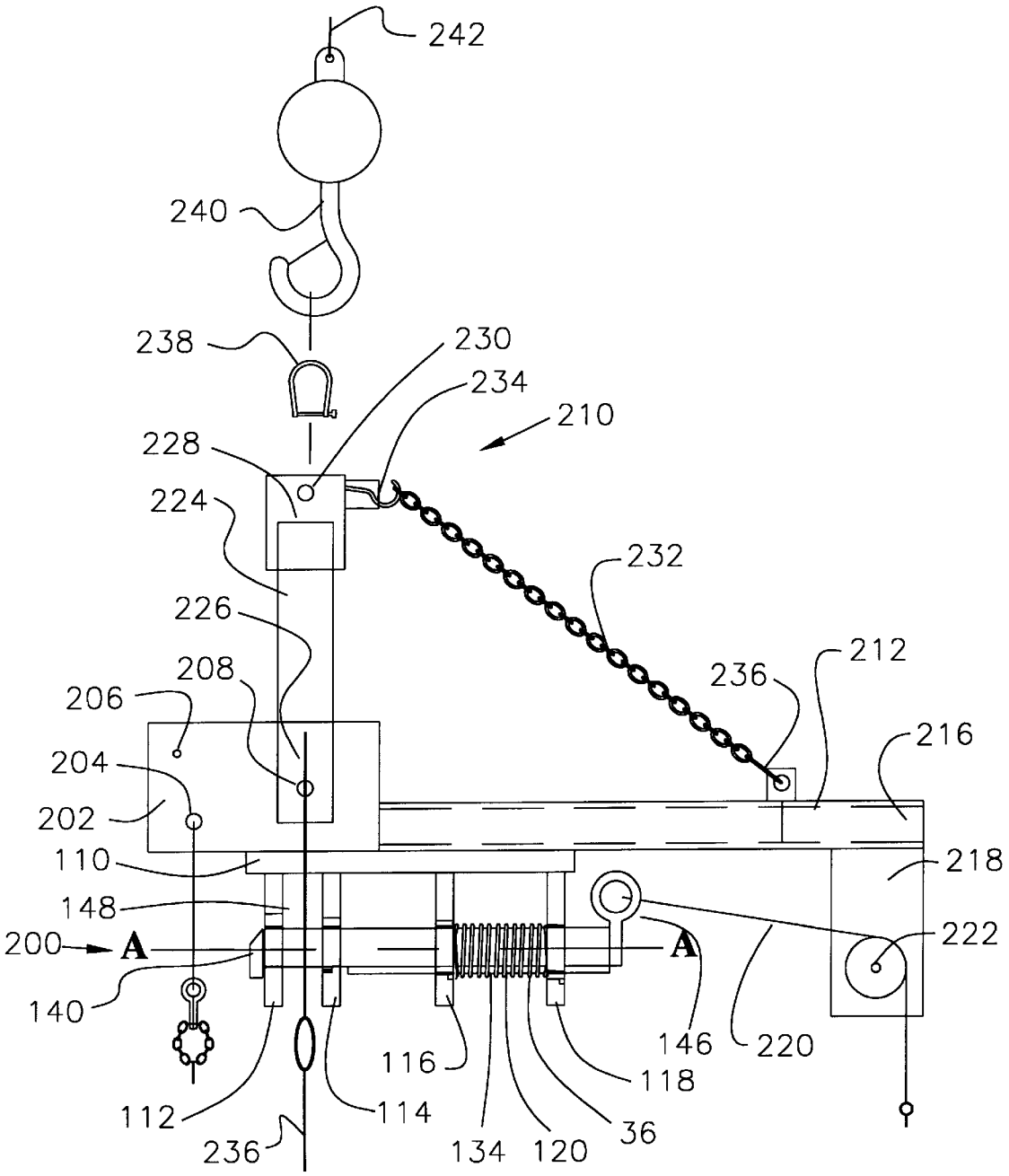
FIG. 10 is the latch member of FIG. 9 in the loaded position.

Referring now to FIG. 10, the latch member 200 of FIG. 9 in the loaded position will now be described. Thus, the operator has placed the sling within the chamber 148, with the sling 236 having load attached thereto. The load will act against the load pin 120, and thus, the load pin 120 will pivot to the horizontal position seen in FIG. 10. A shackle 238 will be attached to the aperture 230, and the load will be suspended via a hook and ball 240 that is attached to a crane line 242 as is well understood in the art. The load thus lifted will cause the swing arm 224 to pivot to an essentially vertical position such as seen in FIG. 10. As the swing arm 224 is moved from the inclined position to the vertical position, the spring 232 will be stretched due to the applied load. Note that in the loaded position seen in FIG. 10, the load pin 120 is essentially horizontal to the ground level and the activation line 220 is at an angle relative to the line A—A. Further, the load pin 120 is locked into position via the lip as previously described. Also, the sling 236, the chamber 148 and the swing arm 224 are axially aligned.

Figure 11:
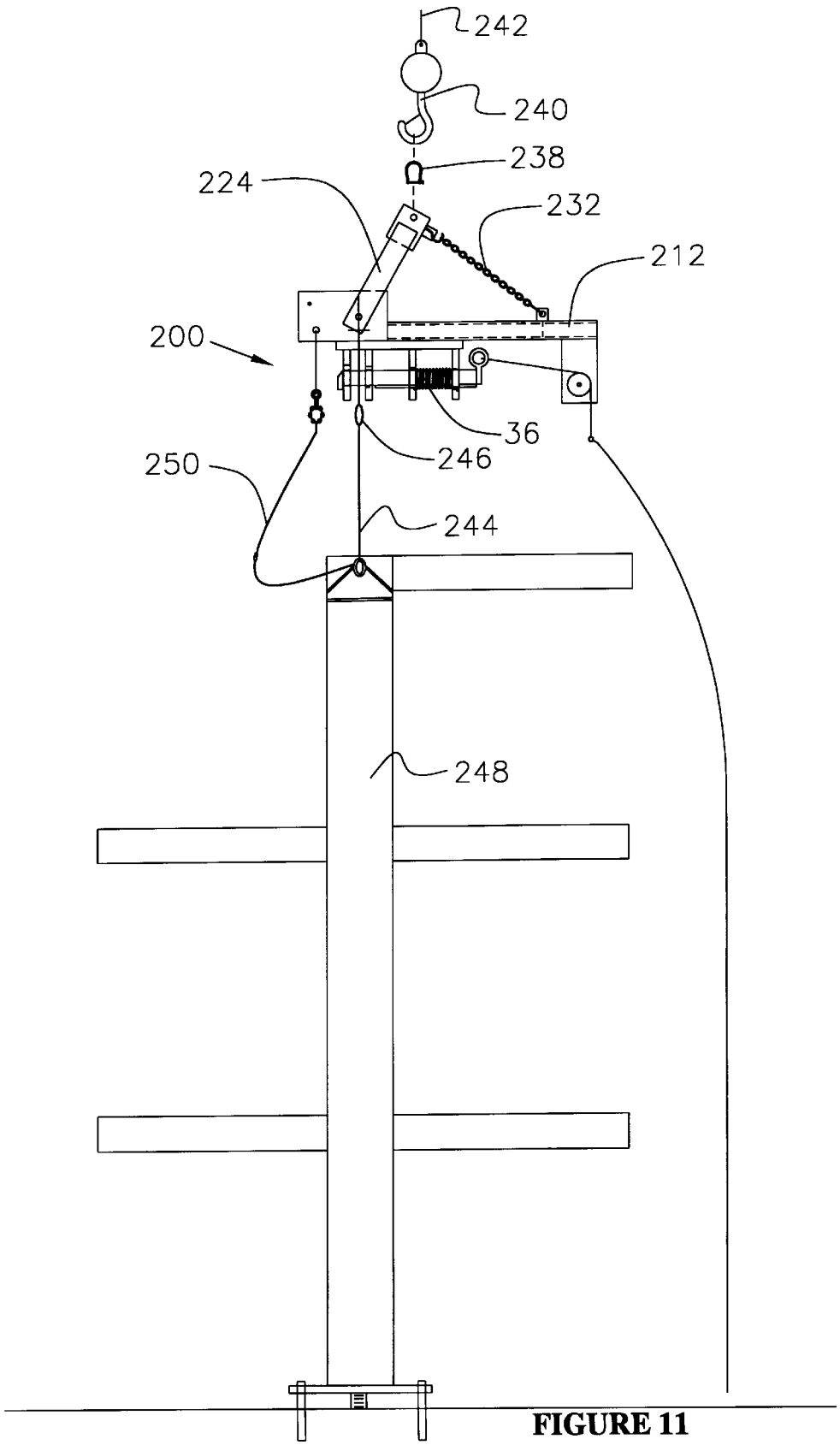
FIG. 11 is the latch member of FIG. 9 being utilized to erect a single column.

Referring to FIG. 11, the latch member of FIG. 9 being utilized to erect a single column is illustrated. Thus, the advantage of utilizing the present latch means 200 with a single point release and single point attachment system is demonstrated. The application teaches having the shackle 238 placed through the aperture 230. With no load placed within the chamber 148, the spring 232 will bias the swing arm 224 to the angled position such that the gravity center is essentially at the position of the aperture 230 seen in FIG. 11 so that the latch 200 and extension member 212 are suspended horizontal to the ground level.

In operation, the operator may attach the shackle 238 to a hook and ball 240 that is attached to a crane line 242 as is well understood in the art. The sling 244 will have the eye 246 that will be placed within the chamber 148. The sling 244 will be wrapped about the single column 248, and therefore, may be lifted in accordance with the teachings of this invention. Further, after the single column has been lifted to the desired location and/or position, the sling 244 may be released. A stripper chocker 250 has been included. The stripper chocker 250 is used to retrieve the sling 244 after the sling 244 has been released from the latch 200. The stripper chocker 250 is attached to the connecting plate 202 via the aperture 204. Stripper chockers are well understood in the art.

Figure 12:
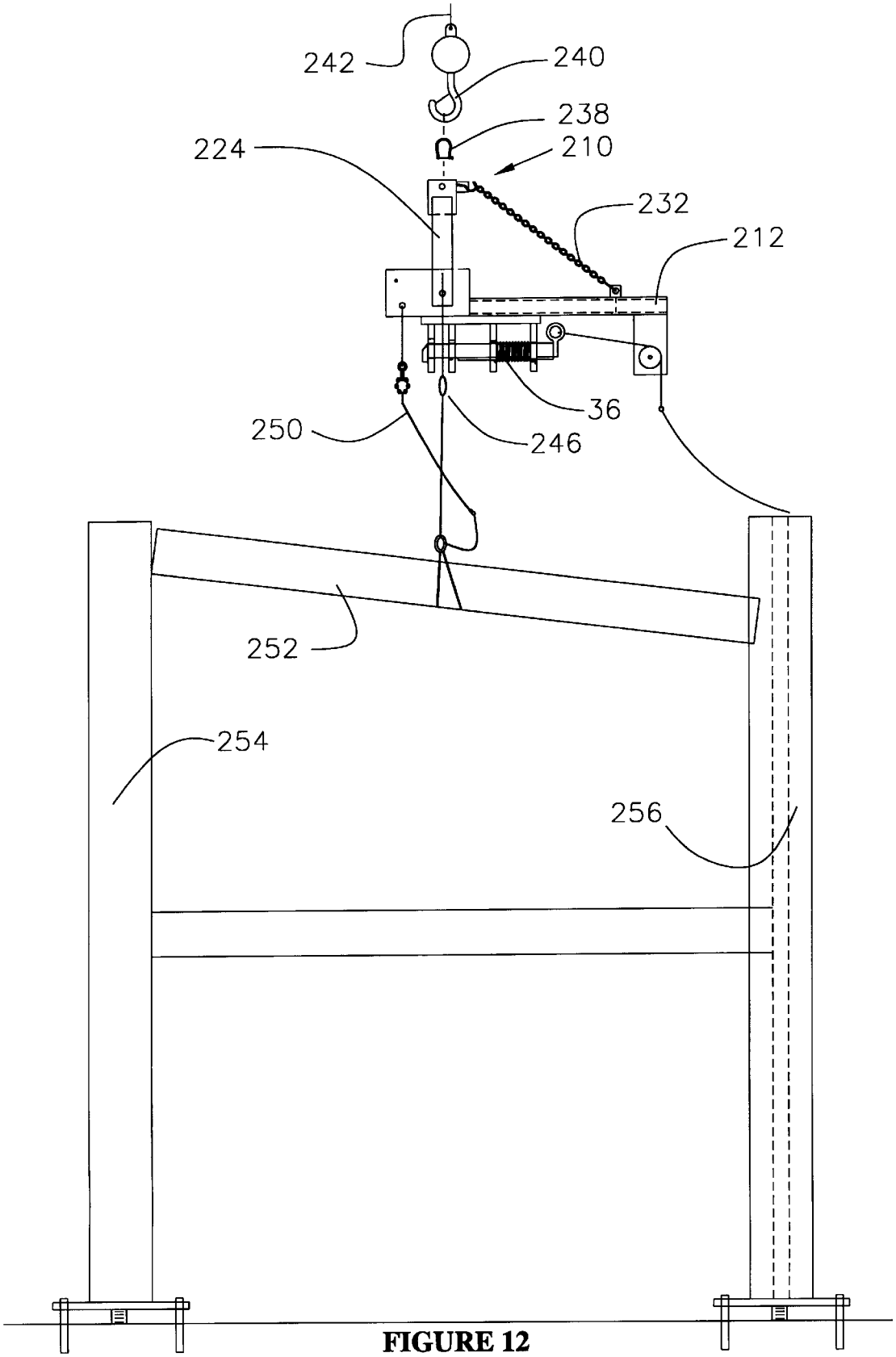
FIG. 12 is the latch member of FIG. 9 being utilized to erect a beam between two columns.

The embodiment of FIG. 9 is depicted in FIG. 12 which shows the latch 200 being utilized to erect a beam 252 between column 254 and column 256. In FIG. 12, the illustration demonstrates the latch member 200 with the load applied; therefore, the spring 232 has been stretched and the swing arm 224 has been pivoted to a vertical position.

In operation of the third embodiment, which is the preferred embodiment of this application, a method of carrying a load with the releasing latch 200 is disclosed. The releasing latch 200 is connected to a single point such as to a shackle 238, with the shackle 238 being connected to a hook and ball 240, and the load may be released from a single point such as the chamber 148. The method includes carrying the load so that a downward force is exerted via the sling means 244 in the closed chamber 148 which in turn will extend the swing arm 224 of the centering means 210 in a vertical position. The operator may thereafter slacken the load on a foundation so that the downward force is no longer applied to the sling means 244 in the closed chamber 148. The swing arm 224 will be rotated to the inclined position so that the second end 228 of the swing arm 224 is the center of gravity of the release latch 200.

The method will also entail pivoting the load pin 120 on the fulcrum point created in the guide members. The operator may then urge the load pin 120 through the passages in a first direction so that the chamber 148 is opened and the sling means 244 may be released. The method may further include placing the sling means 244 within the opened chamber 148 and urging the load pin 120 through the passages in the opposite direction so that the chamber 148 is closed. The novel latch 200 will then pivot the load pin 120 on the fulcrum point so that the key means engages the guide member. The operator may then lift the load from the foundation so that a downward force is exerted via the sling means 244 in the closed chamber 148 so that the load is carried. The novel latch mechanism 200 in conjunction with the centering means 210 will rotate the swing arm 224 to a vertical position so that the second end 228 of the swing arm 224 is in a vertical position relative to the force of the load being exerted.

The foregoing description is provided for illustrating purposes only and is not considered limiting. Numerous additions, substitutions and other modifications can be made without departing from the spirit and scope of the present invention.

I claim:

1. A latch mechanism comprising:

a connection plate having an underside portion;

latch means, attached to said connection plate, for latching a load; wherein said latch means includes: a carrier plate attached to said underside portion of said connection plate; a guide member operatively connected to said carrier plate, said guide member having a passage; a load pin having a first end and a second end, said pin being disposed within said passage; and biasing means, disposed about said pin, for biasing said load pin into engagement with said guide member;

an extension member extending from said connection plate;

a swing arm having a first end and a second end, and wherein said first end is pivotally mounted on said connection plate;

a spring having a first end and a second end, with said first end being attached to said extension member and wherein the second end is attached to said second end of said swing arm so that a center of gravity is formed in said latch mechanism thereby placing said extension member in a horizontal position relative to the ground in an unloaded position.

2. The latch mechanism of claim 1 wherein said guide member comprises:

a first member being attached to said carrier plate; a second member being attached to said carrier plate; a third member being attached to said carrier plate; and a fourth member being attached to said carrier plate;

and wherein said first member and said second member form a chamber for insertion of a line formed on a sling member therein.

3. The latch mechanism of claim 2 wherein said passage comprises a first opening having a first diameter formed within said first member, a second opening having a second diameter formed within said second member, a third opening having a third diameter formed within said third member, and a fourth opening having a fourth diameter formed within said fourth member;

and wherein said first diameter is axially offset relative to said second diameter, said second diameter is axially offset relative to said third diameter, and said third diameter is axially offset relative to said fourth diameter.

4. The latch mechanism of claim 3 further comprising:

a guide pin attached to said load pin;

a first channel formed in said third opening and formed to slidably receive said guide pin;

and wherein a fulcrum point for said load pin is formed on said third member.

5. The latch mechanism of claim 4 further comprising:

a lip member formed in said second opening to engage a key member attached to said load pin.

6. The latch mechanism of claim 4 further comprising;

a first roller bearing member operatively positioned within said first channel; and, a second roller bearing member operatively positioned within said second channel.

7. The latch mechanism of claim 4 further comprising:

a load pin handle being attached to said load pin and wherein an activation line for activating said load pin is connected to said load pin handle.

8. An apparatus for releasing an attached load, the apparatus comprising;

a single point sling means for attaching the load to a single connection point;

a connection plate having an underside face;

a latch member, attached to said underside face, for latching and unlatching the single point sling means from the load and wherein said latch member comprises: a carrier plate attached to said underside portion of said connection plate; a guide member operatively connected to said connection plate, said guide member having a passage therethrough; a load pin having a first end and a second end; a spring being disposed about said load pin, for biasing said load pin into engagement with said guide member;

an extension member extending from said connection plate;

centering means, attached to said connection plate and said extension member, for urging the apparatus into a gravity center position wherein said centering means comprises: a swing arm having a first end and a second end, with said first end of said swing arm being connected to said connection plate; and, a spring member having a first end and a second end, with said first end of said spring member being attached to said second end of said swing arm and said second end of said spring member being attached to said extension member; and wherein said spring member biases said swing arm in a horizontal position relative to the ground in an unloaded position.

9. The apparatus of claim 8 further comprising:

an activating line attached to said latch member;

activating means, attached to said activating line, for activating said latch member.

10. The apparatus of claim 9 wherein said activating means comprises:

a line attached to one end of said load pin, and a block attached to said extension member.

11. The apparatus of claim 8 wherein said guide member comprises:

a first member being connected to said carrier plate; a second member being connected to said carrier plate; a third member being connected to said carrier plate; and a fourth member being connected to said carrier plate;

and wherein said first member and said second member form a chamber for insertion of a line formed on a sling member therein.

12. The apparatus of claim 11 further comprising:

a guide pin attached to said load pin;

a first channel formed in said third member and formed to slidably receive said guide pin;

a second channel formed in said fourth member and formed to slidably receive said guide pin;

and wherein a fulcrum point is formed on said third member.

13. The apparatus of claim 11 wherein said first member has a first opening having a first diameter, said second member has a second opening having a second diameter, said third member has a third opening having a third diameter, and said fourth member has a fourth opening having a fourth diameter;

and wherein said first diameter is axially offset relative to said second diameter, said second diameter is axially offset relative to said third diameter and said third diameter is axially offset relative to said fourth diameter.

14. A method of carrying a load with a releasing latch, said releasing latch includes: a single point sling means for attaching the load to a single connection point; a connection plate having an underside face; a carrier plate attached to said underside face of said connection plate; a latch member, attached to said underside face, for latching and unlatching the sling means from the load; and an extension member attached to said connection plate; and, centering means, attached to said connection plate and said extension member, for forming a center of gravity in said releasing latch; and wherein the method includes;

carrying the load so that a downward force is exerted via the sling means;

moving a swing arm attached to said centering means in a vertical position;

slackening the load on a foundation so that the downward force is no longer applied to the sling means;

rotating said swing arm to an inclined position so that a second end of said swing arm is a gravity center of the releasing latch;

pivoting a load pin on a fulcrum point created in said latch member;

urging said load pin through a passage located in said latch member in a first direction so that an open chamber in said latch member is created;

releasing said sling means from said open chamber.

15. The method of claim 14 further comprising:

placing said sling means within said open chamber;

urging said load pin through said passage in a second direction so that a closed chamber is created;

pivoting said load pin on said fulcrum point so that a key means attached to said load pin engages said latch member;

lifting said load from the foundation so that a downward force is extended via the sling means in the closed chamber so that the load is carried;

rotating said swing arm to a vertical position so that said swing arm is extended to a vertical position relative to the force of the load being exerted.

* * * * *